US012311495B2

(12) United States Patent
Chen et al.

(10) Patent No.: US 12,311,495 B2
(45) Date of Patent: May 27, 2025

(54) TEMPERATURE CONTROL IN CHEMICAL MECHANICAL POLISH

(71) Applicant: Taiwan Semiconductor Manufacturing Co., Ltd., Hsinchu (TW)

(72) Inventors: Kei-Wei Chen, Tainan (TW); Chih Hung Chen, Hsinchu (TW)

(73) Assignee: Taiwan Semiconductor Manufacturing Company, Ltd., Hsinchu (TW)

( * ) Notice: Subject to any disclaimer, the term of this patent is extended or adjusted under 35 U.S.C. 154(b) by 0 days.

(21) Appl. No.: 18/410,408

(22) Filed: Jan. 11, 2024

(65) Prior Publication Data

US 2024/0149388 A1 May 9, 2024

Related U.S. Application Data

(63) Continuation of application No. 16/511,649, filed on Jul. 15, 2019, now Pat. No. 11,904,430, which is a continuation of application No. 15/664,092, filed on Jul. 31, 2017, now Pat. No. 10,350,724.

(51) Int. Cl.

| | |
|---|---|
| ***B24B 37/015*** | (2012.01) |
| ***B24B 37/20*** | (2012.01) |
| ***B24B 37/30*** | (2012.01) |
| ***B24B 53/017*** | (2012.01) |

(52) U.S. Cl.

CPC ..... *B24B 37/015* (2013.01); *B24B 37/20* (2013.01); *B24B 37/30* (2013.01); *B24B 53/017* (2013.01)

(58) Field of Classification Search

CPC ... B24B 37/015; B24B 37/042; B24B 37/005; B24B 37/30; B24B 37/32; B24B 37/10; B24B 37/20; B24B 49/10; B24B 49/14; B24B 49/18; B24B 53/095; B24B 53/017; B24B 55/02; B24B 57/02; F25B 29/00; G05D 23/13; G05D 23/1306; F28D 2021/0077; F28D 2021/0078

USPC .... 451/5, 7, 41, 53, 56, 285, 287, 398, 443, 451/449

See application file for complete search history.

(56) References Cited

U.S. PATENT DOCUMENTS

| | | | |
|---|---|---|---|
| 6,150,271 | A | 11/2000 | Easter et al. |
| 6,402,597 | B1 | 6/2002 | Sakurai et al. |
| 7,040,967 | B2 | 5/2006 | Benner |
| 7,214,123 | B2 | 5/2007 | Han |

(Continued)

FOREIGN PATENT DOCUMENTS

| | | | | |
|---|---|---|---|---|
| CN | 1652304 A | * | 8/2005 | |
| CN | 1943988 A | * | 4/2007 | ..... B24B 37/32 |

(Continued)

OTHER PUBLICATIONS

Machine translation of CN-205465663-U (Year: 2016).*

(Continued)

*Primary Examiner* — Robert F Neibaur

(74) *Attorney, Agent, or Firm* — Slater Matsil, LLP

(57) ABSTRACT

A method includes polishing a wafer on a polishing pad, performing conditioning on the polishing pad using a disk of a pad conditioner, and conducting a heat-exchange media into the disk. The heat-exchange media conducted into the disk has a temperature different from a temperature of the polishing pad.

20 Claims, 8 Drawing Sheets

(56) References Cited

U.S. PATENT DOCUMENTS

| | | | | |
|---|---|---|---|---|
| 9,579,768 | B2 | 2/2017 | Motoshima et al. | |
| 9,731,401 | B2 | 8/2017 | Maruyama et al. | |
| 9,999,957 | B2 | 6/2018 | Choi et al. | |
| 10,414,018 | B2 | 9/2019 | Maruyama et al. | |
| 10,589,398 | B2 | 3/2020 | Eto et al. | |
| 10,710,208 | B2 | 7/2020 | Maruyama et al. | |
| 2004/0087248 | A1 | 5/2004 | Hirokawa | |
| 2007/0123154 | A1 | 5/2007 | Nabeya | |
| 2013/0331005 | A1 | 12/2013 | Gawase et al. | |
| 2017/0239778 | A1* | 8/2017 | Maruyama | B24B 37/20 |

FOREIGN PATENT DOCUMENTS

| | | | | | |
|---|---|---|---|---|---|
| CN | 101301735 | A | * | 11/2008 | |
| CN | 101817162 | A | * | 9/2010 | B24B 37/04 |
| CN | 202428310 | U | * | 9/2012 | |
| CN | 102729133 | A | * | 10/2012 | |
| CN | 104416451 | A | * | 3/2015 | B24B 37/015 |
| CN | 104858785 | A | * | 8/2015 | B24B 37/015 |
| CN | 205021393 | U | * | 2/2016 | H01L 21/02024 |
| CN | 205465663 | U | * | 8/2016 | |
| JP | 2000343416 | A | * | 12/2000 | B24B 37/015 |
| JP | 2007144564 | A | * | 6/2007 | B24B 53/017 |

OTHER PUBLICATIONS

Machine translation of CN-205021393-U (Year: 2016).*
Machine translation of CN-104858785-A (Year: 2015).*
Machine translation of CN-202428310-U (Year: 2012).*
Machine translation of CN-102729133-A (Year: 2012).*
Machine translation of CN-101817162-A (Year: 2010).*
Machine translation of CN-101301735-A (Year: 2008).*
Machine translation of JP-2007144564-A (Year: 2007).*
Machine translation of CN-1943988-A (Year: 2007).*
Machine translation of CN-1652304-A (Year: 2005).*
Machine translation of JP-2000343416-A (Year: 2000).*
Machine translation of CN-104416451-A (Year: 2015).*

* cited by examiner

TEMPERATURE CONTROL IN CHEMICAL MECHANICAL POLISH

PRIORITY CLAIM AND CROSS-REFERENCE

This application is a continuation of U.S. patent application Ser. No. 16/511,649, entitled "Temperature Control in Chemical Mechanical Polish," filed on Jul. 15, 2019, which is a continuation of U.S. patent application Ser. No. 15/664,092, entitled "Temperature Control in Chemical Mechanical Polish," filed on Jul. 31, 2017, now U.S. Pat. No. 10,350,724, issued Jul. 16, 2019, which applications are incorporated herein by reference.

BACKGROUND

Chemical Mechanical Polishing (CMP) is a common practice in the formation of integrated circuits. Typically, CMP is used for the planarization of semiconductor wafers. CMP takes advantage of the synergetic effect of both physical and chemical forces for the polishing of wafers. It is performed by applying a load force to the back of a wafer while the wafer rests on a polishing pad. Both the polishing pad and the wafer are rotated while a slurry containing both abrasives and reactive chemicals is passed therebetween. CMP is an effective way to achieve global planarization of wafers.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
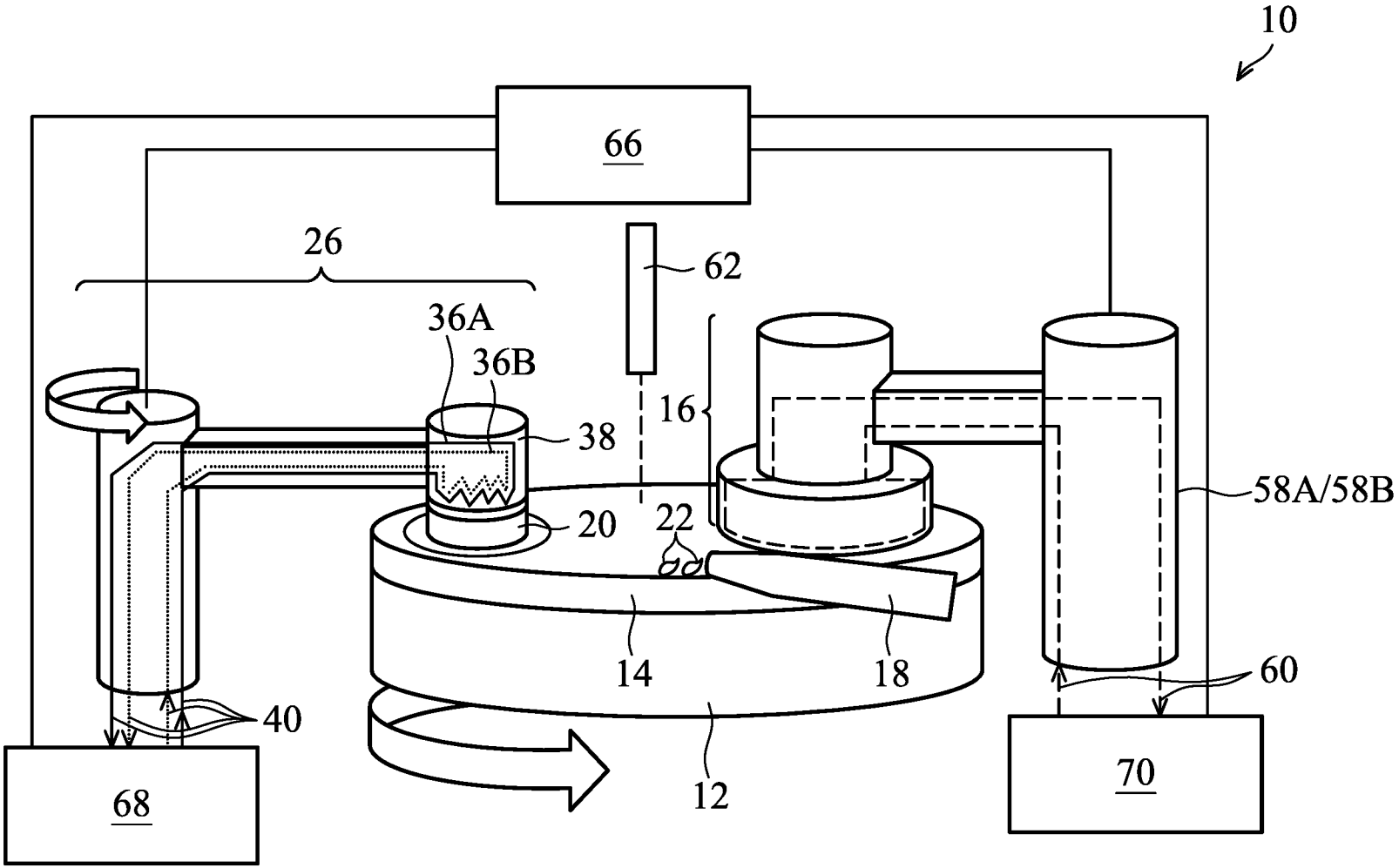
FIG. 1 schematically illustrates a part of a Chemical Mechanical Polish (CMP) apparatus/system in accordance with some embodiments.

The following disclosure provides many different embodiments, or examples, for implementing different features of the invention. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "underlying," "below," "lower," "overlying," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

A method of controlling the temperature of a polishing pad during Chemical Mechanical Polish (CMP) processes and the apparatus of controlling the temperature are provided in accordance with various exemplary embodiments. The steps of achieving the temperature control are illustrated in accordance with some embodiments. Some variations of some embodiments are discussed. Throughout the various views and illustrative embodiments, like reference numbers are used to designate like elements. Throughout the description, when a wafer is referred to as being "polished," it represents that a CMP is performed on the wafer.

FIG. 1 schematically illustrates a part of a CMP apparatus/system in accordance with some embodiments of the present disclosure. CMP system 10 includes polishing platen 12, polishing pad 14 over polishing platen 12, and wafer holder 16 over polishing pad 14. Slurry dispenser 18 has an outlet directly over polishing pad 14 in order to dispense slurry 22 onto polishing pad 14. Disk 20 of pad conditioner 26 is also placed on the top surface of polishing pad 14. Disk 20 may also be referred to as a condition disk in the present disclosure.

During the CMP, slurry 22 is dispensed by slurry dispenser 18 onto polishing pad 14. Slurry 22 includes a reactive chemical(s) that can react with the surface layer of the wafer to be polished. Furthermore, slurry 22 includes abrasive particles for mechanically polishing the wafer.

Figure 5:
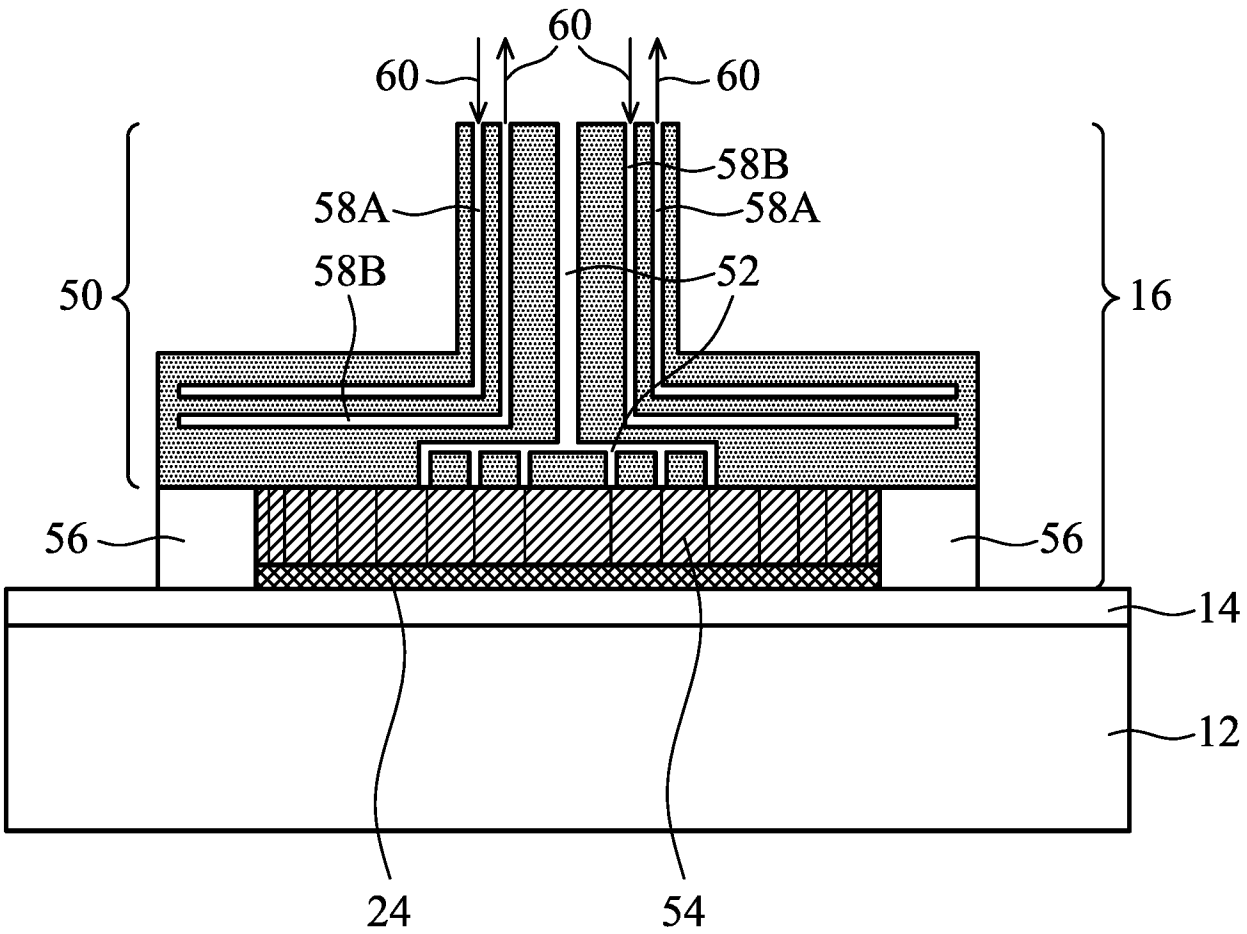
FIG. 5 illustrates a cross-sectional view of a wafer holder in accordance with some embodiments.

Polishing pad 14 is formed of a material that is hard enough to allow the abrasive particles in slurry 22 to mechanically polish the wafer, which is held in wafer holder 16 (refer to FIG. 5). On the other hand, polishing pad 14 is also soft enough so that it does not substantially scratch the wafer. During the CMP process, polishing platen 12 is rotated by a mechanism (not shown), and polishing pad 14 fixed thereon is also rotated along with the rotating polishing platen 12. The mechanism (such as a motor and the driving parts) for rotating polishing pad 14 is not illustrated.

On the other hand, during the CMP process, a part of wafer holder 16 is also rotated, and hence causing the rotation of wafer 24 (FIG. 5) fixed inside wafer holder 16. In accordance with some embodiments of the present disclosure, wafer holder 16 and polishing pad 14 rotate in the same direction (both being clockwise or counter-clockwise when viewed from the top of CMP apparatus 10). In accordance with alternative embodiments of the present disclosure, wafer holder 16 and polishing pad 14 rotate in opposite directions. The mechanism for rotating wafer holder 16 (alternatively referred to as polishing head) is not illustrated. With the rotation of polishing pad 14 and wafer holder 16, and further because of the movement (swinging) of wafer holder 16 on polishing pad 14, slurry 22 is dispensed between wafer 24 and polishing pad 14. Through the chemical reaction between the reactive chemical in slurry 22 and the surface layer of wafer 24, and further through the mechanical polishing, the surface layer of wafer 24 is planarized.

Pad conditioner 26 is used for the conditioning of polishing pad 14. FIG. 1 illustrates disk 20, which is a part of pad conditioner 26, placed over polishing pad 14. Disk 20 may include a metal plate and abrasive grits (not shown separately) fixed on the metal plate. The metal plate may be formed of stainless steel in accordance with some embodiments. The abrasive grits may be formed of, for example, diamond. Disk 20 has the function of cleaning and removing the undesirable by-products generated on polishing pad 14 during the CMP process. Also, the abrasive grits on the disk 20, when contacting and abrading against polishing pad 14, has the function of maintaining the roughness of polishing pad 14, so that polishing pad 14 may have adequate roughness for performing the mechanical grinding function. In accordance with some embodiments of the present disclosure, disk 20 is put to contact with the top surface of polishing pad 14 when polishing pad 14 is to be conditioned. During the conditioning, both polishing pad 14 and disk 20 rotate, so that the abrasive grits of disk 20 scratch the top surface of polishing pad 14, and hence re-texturize the top surface of polishing pad 14. Furthermore, during the CMP process, both disk 20 and wafer holder 16 may swing between the center of polishing pad 14 and the edge of polishing pad 14.

The CMP process has chemical effect and mechanical effect working together to achieve the planarization of the wafer. As shown in FIG. 1, to perform a CMP, slurry 22 is dispensed, which includes reactive chemicals and an abrasive. The chemical effect is resulted due to the reaction of the reactive chemical in slurry with the surface material of the wafer. The mechanical effect is resulted due to the abrasion caused by the abrasive in slurry 22 to the wafer. Both the chemical effect and mechanical effect may result in the temperature of the wafer to be increased over time. For example, the chemical reaction may result in heat to be released, and the mechanical effect also generates frictional heat. Due to the chemical effect and mechanical effect, the temperature of polishing pad 14 and the wafer may increase and vary during the CMP.

Figure 2:
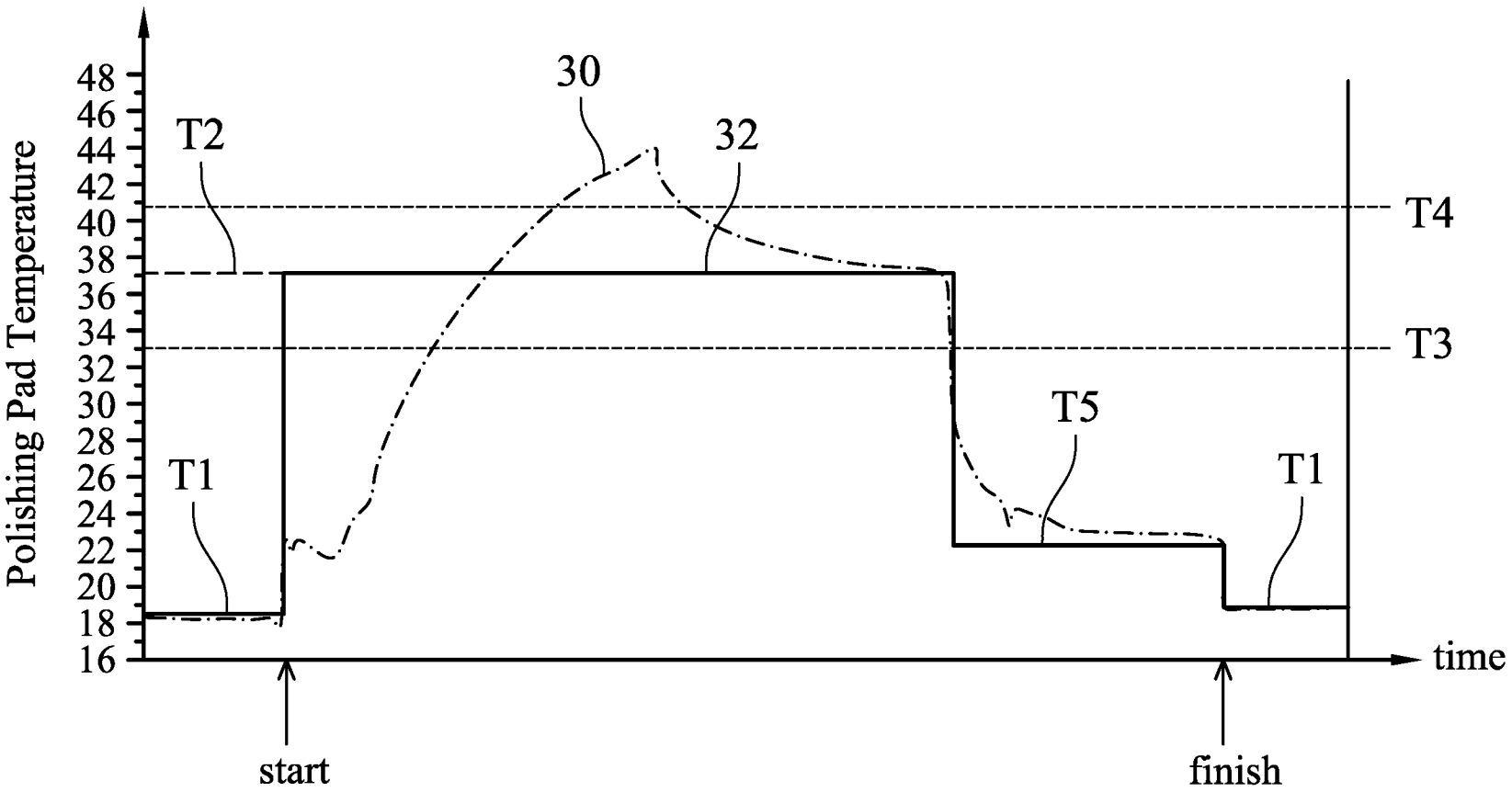
FIG. 2 illustrates some temperature profiles of polishing pads in CMP processes in accordance with some embodiments.

For example, FIG. 2 illustrates the temperatures of a polishing pad as a function of time. The "start" time represents a starting time a wafer is polished, and the "finish" time represents a finishing time of the CMP performed on the same wafer. Line 30 represents an actual temperature of the polishing pad on which the wafer is polished. During an initial stage of the CMP, the temperature T1 of a wafer is low, which may be room temperature (about 21° C., for example) or slightly higher. At the low temperature, the CMP rate, which is measured as the thickness of the wafer lost due to CMP per unit time, is low. This adversely results in the throughput of the CMP process to be low.

Over the time of the CMP, as shown byline 30 in FIG. 2, the temperature of the polishing pad is increased, until the temperature of the polishing pad reaches a peak temperature. When the temperature is increased, the chemical reaction is accelerated, while the polishing pad becomes softer. For example, the polishing pad may include organic materials that become softer under elevated temperatures, which may be due to that the higher temperatures are closer to the corresponding glass transition temperature of the materials in the polishing pad. This results in the mechanical effect to be reduced, while the chemical effect is strengthened. If the temperature is too high, dishing may occur in the polished wafer, so that some parts of the wafer are recessed more than other parts. Adversely, the mechanical effect, which is supposed to cause the removal of protruding parts of the wafer without removing the recessed parts of the wafer, is weakened and hence is unable to eliminate the dishing. The reason is that a hard polishing pad will contact and polish the protruding parts of the wafer, and will not contact and polish the dishing parts of the wafer. A polishing pad with weakened mechanical property is softer, and hence may change its shape when pressed against wafer during the polishing. Accordingly, the soft polishing pad may also be in contact with, and hence polishes, the dishing parts of the wafer.

Accordingly, with the low temperatures of polishing pad 14 (FIG. 1) resulting in a low throughput of the CMP process, and the high temperatures of polishing pad 14 resulting in the dishing of the polished wafer, it is desirable that during the CMP, the temperature of polishing pad 14 is maintained within a desirable range, which is represented as the range between temperatures T3 and T4. The temperature of polishing pad 14 is preferably maintained around an optimal temperature (such as T2 as shown in FIG. 2. Within the desirable temperature range, the throughput of the CMP process is high enough, and the dishing effect is controlled within an acceptable level. Line 32 represents a desirable temperature profile of polishing pad 14 in accordance with some embodiments. Line 32 indicates that it is desirable that during at least a part of the CMP process, the temperature of polishing pad 14 is to be maintained at the optimal temperature T2.

It is also realized that the CMP process may include a plurality of sub-stages with different optimal temperatures due to different CMP conditions such as different slurries/chemicals, different rotation speed of wafer, etc. For example, FIG. 2 illustrates an example (as shown by line 32), in which after the stage during which polishing pad 14 is controlled to have temperature T2, the optimal temperature of polishing pad 14 is T5. In other examples, there may be a single desirable temperature or more than two desirable temperatures in the CMP of a wafer.

Figure 4:
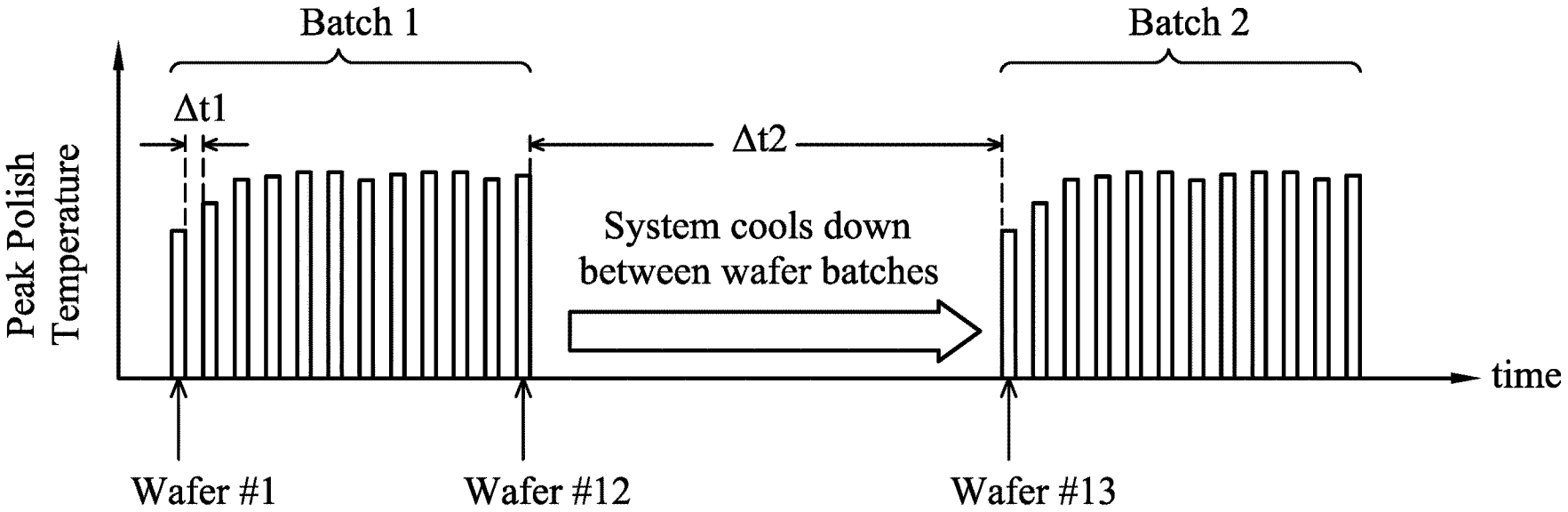
FIG. 4 schematically illustrates the peak temperatures of a polishing pad as a function of the sequence of polished wafers in accordance with some embodiments.

Besides the heat generated during the CMP, the temperature of the polishing pad (such as polishing pad 14 in FIG. 1) is also affected by other factors. For example, wafers are typically grouped as batches or lots, each including a plurality of wafers. The polishing pad has a peak temperate during the polishing of each of wafer, and FIG. 4 illustrates the peak temperatures of the polishing pad as a function of the sequence of the wafers being polished. The interval between wafers in the same batch and the interval between different patches are different, resulting in the temperature of polishing pad to fluctuate. Between the wafers in the same batches (such as batch 1 and batch 2), there is time interval Δt1. During the same batch, the peak temperatures of the polishing pad for polishing the first several wafers gradually increase, and are eventually stabilized for the subsequent wafers. Between batches, there is time interval Δt2, which is the period of time ending at the finishing time of the last wafer (such as wafer #12) of the previous batch (such as batch 1) and the first wafer (wafer #13) of the subsequent batch (batch 2). Time interval Δt2 is significantly longer than time interval Δt1, and hence the polishing pad cools down more during this time. When wafer #13 is polished, the temperature of the polishing pad has to start ramping up again. As a result, the temperature of the polishing pad, affected by various factors, is difficult to control.

Figure 8B:
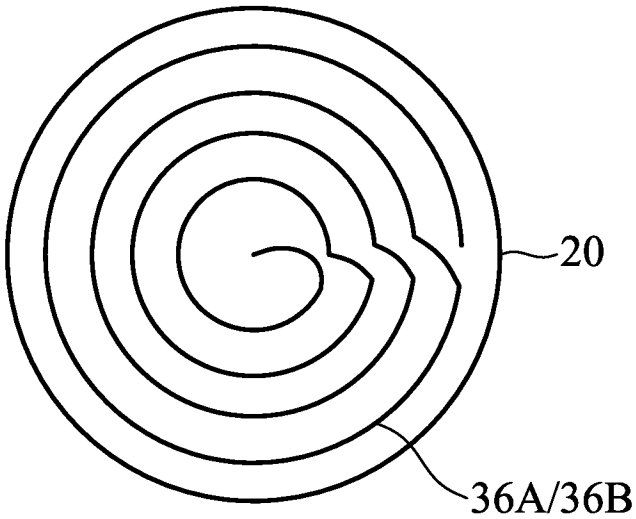
FIGS. 8A and 8B illustrate a zigzag arrangement and a spiral shape of channels for conducting coolant or heating media, respectively, in accordance with some embodiments.
Figure 8A:
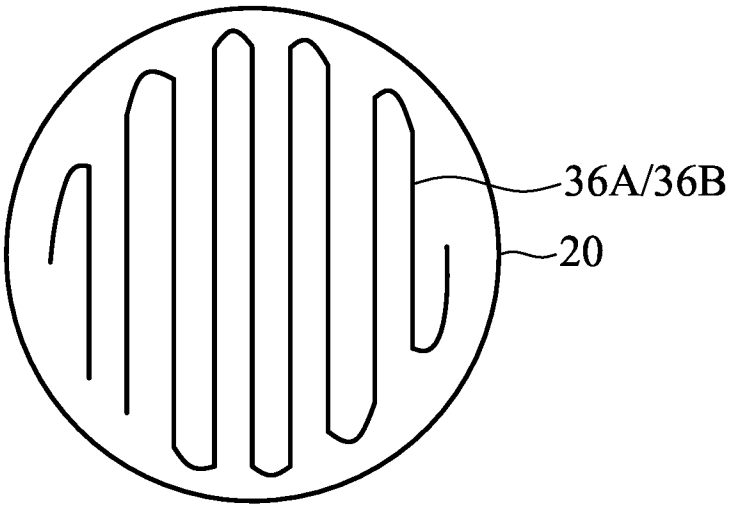

In accordance with some embodiments of the present disclosure, as shown in FIG. 1, channel 36A is built in pad conditioner 26. Channel 36A includes a hollow channel used to conduct heat-carrying media 40, which flows into channel 36A, exchanges heat with disk 20, and flows out of channel 36A. Since disk 20 is in contact with the top surface of polishing pad 14, heat is conducted between disk 20 and polishing pad 14. Accordingly, heat-carrying media 40 may be used to heat or cool polishing pad 14. Channel 36A, when viewed from the top of disk 20, may have a top view shape selected from, and are not limited to, a zig-zag shape (FIG. 8A) and a spiral shape, as schematically illustrated in FIGS. 8A and 8B, respectively.

Pad conditioner 26 includes disk holder 38, to which disk 20 is attached. In accordance with some embodiments of the present disclosure, channel 36A has a part built inside disk holder 38, and channel 36A does not extend into disk 20. Since disk holder 38 and disk 20 rotate during the conditioning of polishing pad 14, the channel 36A may be formed through rotary union, so that channel 36A may be conducted into the rotational disk holder 38. The design of rotary union is known in the art, and hence is not discussed in detail herein.

In accordance with some embodiments of the present disclosure, heat-exchange media 40 includes a coolant, which has a temperature lower than the temperature of polishing pad 14. The coolant may be oil, de-ionized water, gas, or the like. The temperature of the coolant may also be higher than, equal to, or lower than the room temperature (about 21° C., for example). In accordance with some embodiments of the present disclosure, the temperature of heat-exchange media 40 is in the range between about ° C. and about 18° C. Accordingly, coolant 40 flows through channel 36A, and heat transfers from polishing pad 14 into disk 20, and then into disk holder 38, and is carried out by coolant 40. Polishing pad 14 is thus cooled.

In accordance with some embodiments of the present disclosure, heat-exchange media 40 includes a heating media, which has a temperature higher than the temperature of polishing pad 14. The heating media may also be oil, de-ionized water, gas, or the like. In accordance with some embodiments of the present disclosure, the temperature of heating media 40 is in the range between about 25° C. and about 45° C. Accordingly, when heating media 40 flows through channel 36A, heat transfers from heating media 40 into polishing pad 14 through disk holder 38 and disk 20. Polishing pad 14 is thus heated.

In accordance with some embodiments of the present disclosure, channel 36A is used for both cooling and heating polishing pad 14. For example, when polishing pad 14 needs to be heated, a heating media is conducted through channel 36A, and when polishing pad 14 needs to be cooled, a coolant is conducted through the same channel 36A.

During the conditioning of polishing pad 14, disk 20 swings back and forth between the center and the edge of polishing pad 14. The swinging of disk 20 in combination with the rotation of polishing pad 14 results in disk 20 to be able to heat or cool the entire top surface of polishing pad 14. Furthermore, the heating and the cooling of polishing pad 14 may be performed before, during, and/or after the polishing of each of wafers.

Figure 3:
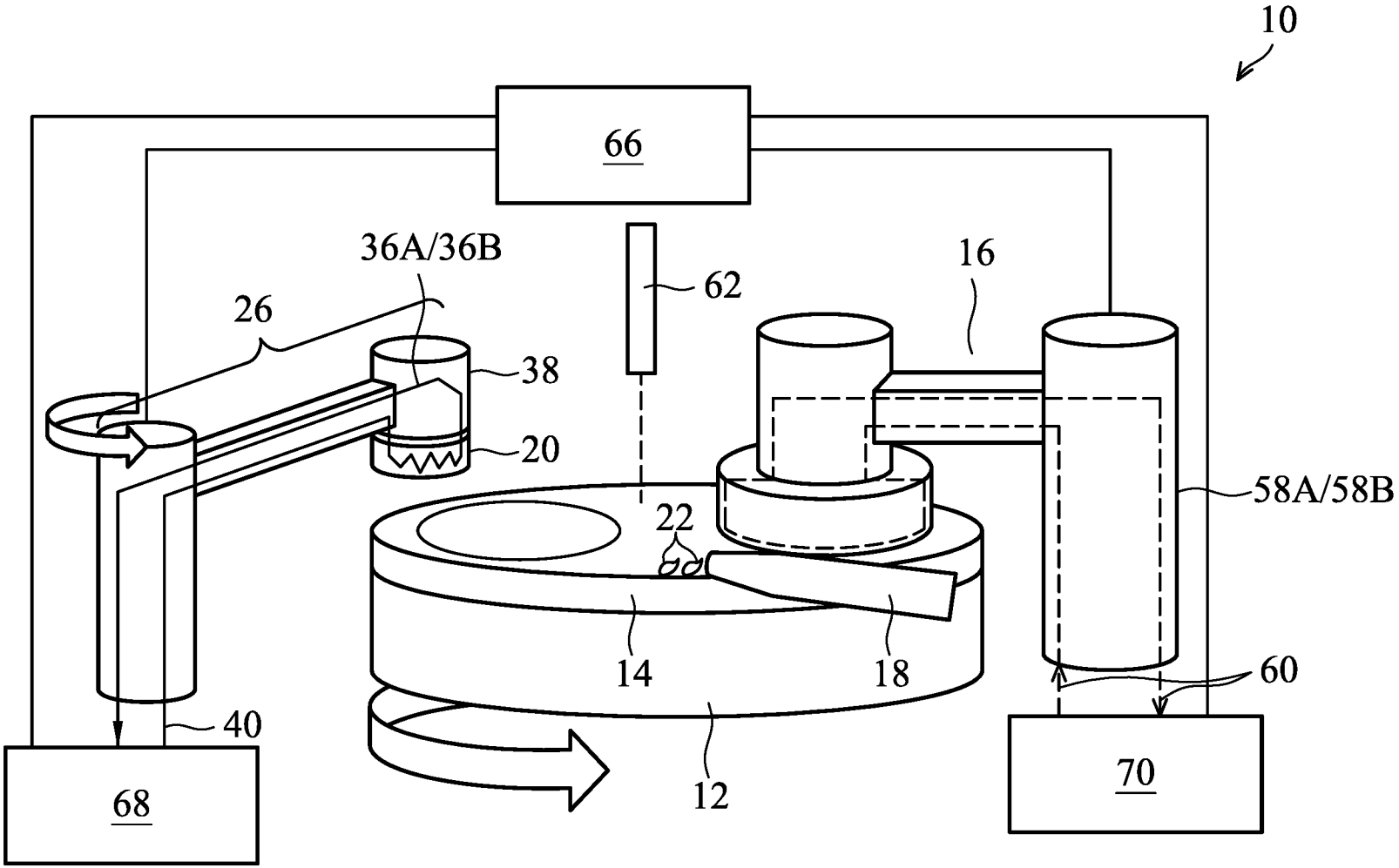
FIG. 3 schematically illustrates a part of a CMP apparatus/system in accordance with some embodiments, with a disk of a pad conditioner moved away from a polishing pad.

The heat-exchange may be stopped by moving disk 20 away from polishing pad 14, which is shown in FIG. 3. This provides a quick stopping of the heat transfer. In accordance with alternative embodiments of the present disclosure, the heat-exchange may be stopped by conducting a media 40 having the same or similar temperature as polishing pad 14. For example, when the difference between the temperature of heat-exchange media 40 and the temperature of polishing pad 14 is lower than about 3° C., the heat-exchange between polishing pad 14 is slow, and may be considered as stopped. The heat-exchange may also be stopped by not conducting any heat-exchange media through channel 36A. These embodiments may be used when the pad conditioning is desired to be continued, while the temperature of polishing pad 14 is already in the desirable range.

In accordance with some embodiments of the present disclosure, pad conditioner 26 has a single channel 36A, as discussed in preceding paragraphs. The respective pad conditioner 26 is thus referred to as a single-channel pad conditioner. In accordance with alternative embodiments of the present disclosure, pad conditioner 26 has a dual-channel design, which is achieved through two channels. For example, FIG. 1 illustrates channel 36B in addition to channel 36A, wherein channel 36B also extends into disk holder 36. Channels 36A and 36B are separate channels that can be operated independently without affecting each other. In accordance with some embodiments of the present disclosure, one of channels 36A and 36B (such as channel 36A) is used for conducting a coolant, and the other channel (such as channel 36B) is used to conduct a heating media. When polishing pad 14 is to be cooled, a coolant is conducted into channel 36A, and the conduction of the heating media through channel 36B is stopped. Conversely, when polishing pad 14 is to be heated, a heating media is conducted into channel 36B, and the conduction of the coolant through channel 36A is stopped. The candidate coolant and heating material may be similar to that is used in the single-channel (one-channel) pad conditioner. When polishing pad 14 neither needs to be heated nor needs to be cooled, for example, when the temperature of polishing pad 14 is in the desirable range T3~T4 (FIG. 2), either the conduction of both coolant and the heating media is stopped, or both being conducted with the media(s) having a temperature the same as or substantially the same as (for example, with a difference smaller than about 3° C.) the temperature of polishing pad 14. In FIG. 1, channel 36B is schematically illustrated using dashed lines to indicate that channel 36B may or may not exist.

In accordance with some embodiments of the present disclosure, channel 58A/58B is formed in wafer holder 16, as shown in FIG. 1. FIG. 5 illustrates a cross-sectional view of an exemplary wafer holder 16. Wafer holder 16 includes wafer carrier assembly 50, which is configured to hold wafer 24. Wafer carrier assembly 50 includes air passages 52, in which vacuum may be generated. By vacuuming air passages 52, wafer 24 may be sucked up for the transportation of wafer 24 to and away from polishing pad 14 (FIG. 1). Air passages 52 may also include some portions in flexible membrane 54, which is used to apply a uniform pressure on wafer 24, so that wafer 24 is pressed against polishing pad 14 during the CMP process. Retaining ring 56 is used to hold wafer 24 in place during the CMP, and to swing wafer 24 back and forth on polishing pad 14 during the CMP process.

In accordance with some embodiments of the present disclosure, channel 58A is built in wafer carrier assembly 50. Although not shown in FIG. 5, each of channels 58A and 58B may form a loop in wafer holder 16, and each of channels 58A and 58B includes an inlet and an outlet as illustrated. Heat-exchange media 60 is conducted into and out of channel 58A. Accordingly, polishing pad 14 can be heated or cooled through the conduction of heat-exchange media 60. Channel 58A and 58B (and also channel 36B) may also have similar top-view shapes as shown in FIG. 8A or 8B.

In accordance with some embodiments of the present disclosure, heat-exchange media 60 includes a coolant, which has a temperature lower than the temperature of polishing pad 14. The coolant 60 may also be oil, de-ionized water, gas, or the like. The temperature may also be higher than, equal to, or lower than the room temperature. In accordance with some embodiments of the present disclosure, the temperature of heat-exchange media 60 is in the range between about ° C. and about 18° C. Accordingly, when heat-exchange media 60 flows through channel 58A, heat transfers from polishing pad 14 into retaining ring 56 and wafer 24, and then into carrier assembly 50, and is carried out by heat-exchange media 60. Polishing pad 14 is thus cooled.

In accordance with some embodiments of the present disclosure, heat-exchange media 60 includes a heating media, which has a temperature higher than the temperature of polishing pad 14. The heating media 60 may also be oil, de-ionized water, gas, or the like. In accordance with some embodiments of the present disclosure, the temperature of heating media 60 is in the range between about 25° C. and about 45° C. Accordingly, when heating media 60 flows through channel 58A, heat transfers from heating media 60 into polishing pad 14 through retaining ring 56 and wafer 24. Polishing pad 14 is thus heated.

In accordance with some embodiments of the present disclosure, carrier assembly 50 is a single-channel assembly, and channel 58A is used for both cooling and heating polishing pad 14. For example, when polishing pad 14 needs to be heated, a heating media is conducted through channel 58A, and when polishing pad 14 needs to be cooled, a coolant is conducted through channel 58A. In accordance with alternative embodiments of the present disclosure, carrier assembly 50 is a dual-channel assembly having channels 58A and 58B built therein. Channels 58A and 58B are separate channels that can be operated independently without affecting each other. In accordance with some embodiments of the present disclosure, one of channels 58A and 58B is used for conducting a coolant, and the other channel is used to conduct a heating media. In the operation of the dual-channel scheme, when polishing pad 14 is to be cooled, a coolant is conducted into channel 58A, and the conduction of the heating media through channel 58B is stopped. Conversely, when polishing pad 14 is to be heated, a heating media is conducted into channel 58B, and the conduction of the coolant through channel 58A is stopped. When polishing pad 14 neither needs to be heated nor needs to be cooled, for example, when the temperature of polishing pad 14 is in the desirable range, either the conduction of both coolant and the heating media is stopped, or both being conducted with the media(s) having a temperature the same as or substantially the same as (for example, with a difference smaller than about 5° C.) the temperature of polishing pad 14.

In accordance with some embodiments of the present disclosure, heat-exchange channels are built in either one of pad conditioner 26 and wafer holder 16. In accordance with alternative embodiments of the present disclosure, heat-exchange channels are built in both of pad conditioner 26 and wafer holder 16 to achieve faster heat exchange. When polishing pad 14 needs to be heated or cooled, either one or both of pad conditioner 26 and wafer holder 16 may be used.

In accordance with some embodiments of the present disclosure, a real-time detection of the temperature of polishing pad 14 is conducted, for example, using a non-contact thermometer. FIG. 1 schematically illustrates thermometer 62 to represent the mechanism for detecting the temperature on polishing pad 14. In accordance with some embodiment, thermometer 62 is an infrared thermometer. The conduction of heat-exchange media 40 and/or 60 is controlled in response to the detected temperature. For example, when the detected temperature is higher than the upper limit T4 (FIG. 2) of the desirable temperature range, a coolant(s) is conducted into channel(s) 36A/36B/58A/58B as discussed above in order to lower the temperature of polishing pad 14. Conversely, when the detected temperature is lower than the lower limit T3 (FIG. 2) of the desirable temperature range, a heating media is conducted into channel(s) 36A/36B/58A/58B as discussed above in order to raise the temperature of polishing pad 14. In accordance with some embodiments of the present disclosure, when the temperature is in the desirable range T3~T4 (FIG. 2), both heating and cooling media are stopped, or the channels are conducted with the heat-exchange medias with temperatures the same as or substantially the same as (for example, with a difference smaller than about 3° C.) the temperature of polishing pad 14. In accordance with some embodiments of the present disclosure, when the temperature is detected as being in the desirable range, disk 20 (FIG. 1) can also be moved away from polishing pad 14 to stop heat transfer.

FIG. 1 further illustrates control unit 66, which is electrically (and/or signally) connected to pad conditioner 26, wafer holder 16, thermometer 62, slurry dispenser 18, and heat-exchange media supplying units 68 and 70. Heat-exchange media supplying units 68 and 70 are configured to supply heating-exchange media 40 and 60, respectively, with the desirable temperatures. Although not shown, each of heat-exchange media supplying units 68 and 70 may include a coolant storage and/or a heating media storage, with the coolant and the heating media stored in the coolant storage and the heating-medias storage, respectively. Control unit 66 has the function of operating and synchronizing the operation of the above-discussed functional units including and not limited to pad conditioner 26, wafer holder 16, thermometer 62, slurry dispenser 18, and heat-exchange media supplying units 68 and 70. Accordingly, the function of detecting and controlling the temperature of polishing pad 14 may be achieved.

Figure 6:
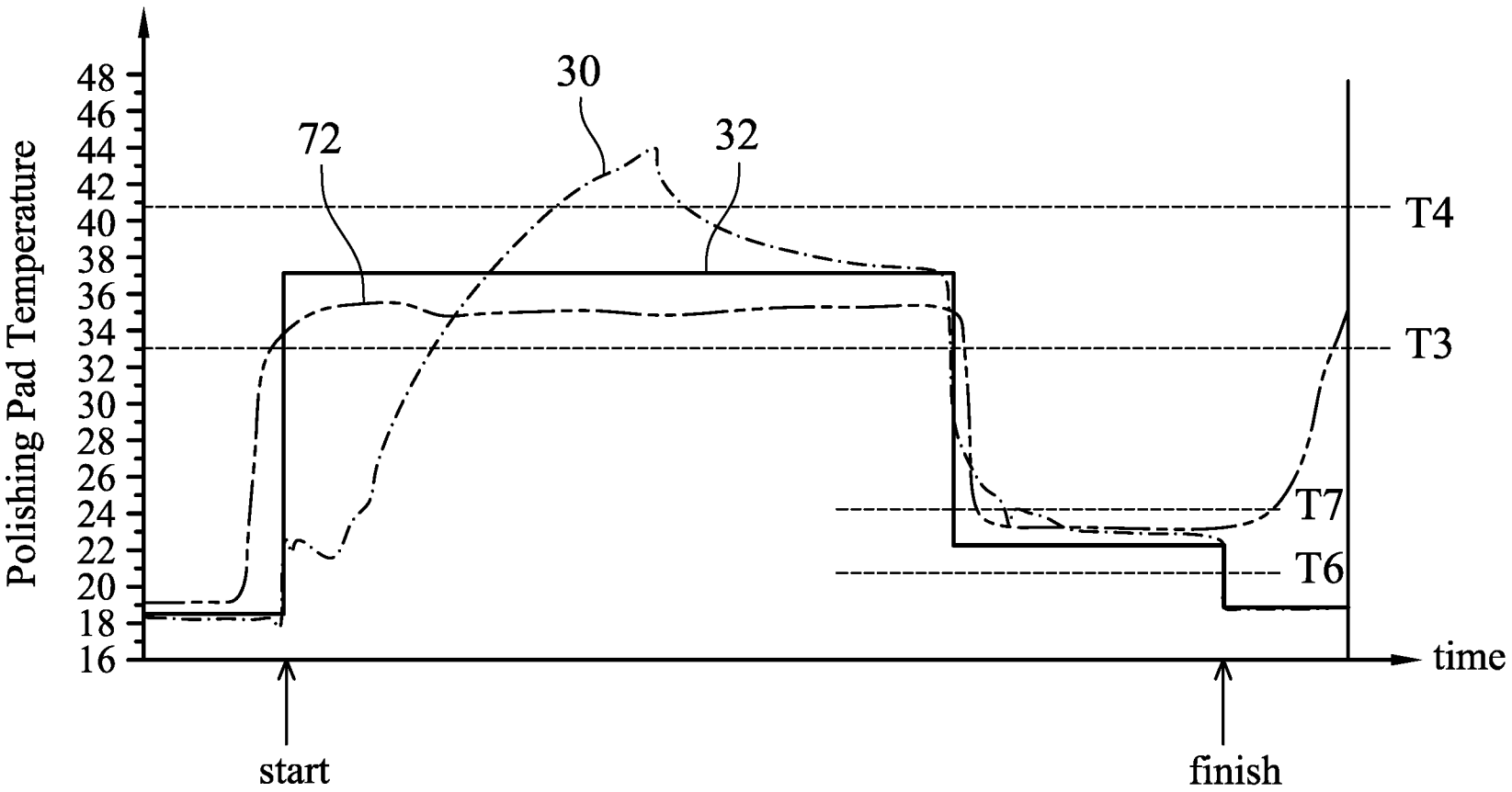
FIGS. 6 and 7 illustrate some temperature profiles of polishing pads in CMP processes in accordance with some embodiments.

FIG. 6 illustrates an exemplary temperature profile of a polishing pad in the CMP process of a wafer. Line 72 represents the temperature of polishing pad 14 when the temperature-control method in accordance with the embodiments of the present disclosure is used. Line 30 still represents the temperature of a polishing pad when the temperature-control method in accordance with the embodiments of the present disclosure is not used. Before the "start" time, at which time point the wafer 24 (FIG. 5) starts to be polished, a heating media 40 and/or 60 (FIG. 1) is conducted into pad conditioner 26 and/or wafer holder 16, so that temperature is raised into the desirable range T3~T4. After the temperature of polishing pad 14 is in the desirable range, the wafer 24 starts to be polished. During the CMP, a coolant 40 and/or 60 may be conducted into pad conditioner 26 (FIG. 1) and/or wafer holder 16 at some time when needed. The heat generated during the chemical reaction and the friction may thus be conducted away, so that the temperature of polishing pad 14 is maintained within the desirable temperature range T3~T4. During a stage in which a lower temperature range T6~T7 is needed, a coolant 40 and/or 60 is conducted to quickly lower the temperature of polishing pad 14 into the desirable temperature range T6~T7. During the interval between the CMP of the wafers in the same batch, and during the interval between different batches, a heating media may be conducted into pad conditioner 26 and/or wafer holder 16 (FIG. 1), so that polishing pad 14 is maintained at an optimal temperature for the next wafer.

During the cooling and the heating, the temperature of the coolant and the heating media can also be controlled. For example, when a fast cooling is desirable, a coolant 40/60 at a first temperature is conducted, and when a slow cooling is desirable, a coolant 40/60 at a second temperature higher than the first temperature (but still lower than the temperature of the polishing pad) is conducted. Similarly, when a fast heating is desirable, a heating media 40/60 at a first temperature is conducted, and when a slow heating is desirable, a heating media 40/60 at a second temperature lower than the first temperature is conducted.

During the cooling and the heating, the flow rate (amount) of the coolant and the heating media flowing into pad conditioner 26 and/or wafer holder 16 can also be controlled. For example, when a fast cooling is desirable, coolant 40/60 is conducted at a first flow rate, and when a slow cooling is desirable, coolant 40/60 is conducted at a second flow rate lower than the first flow rate. Similarly, when a fast heating is desirable, heating media 40/60 is conducted at a first flow rate, and when a slow cooling is desirable, heating media 40/60 is conducted at a second flow rate lower than the first flow rate.

Figure 7:
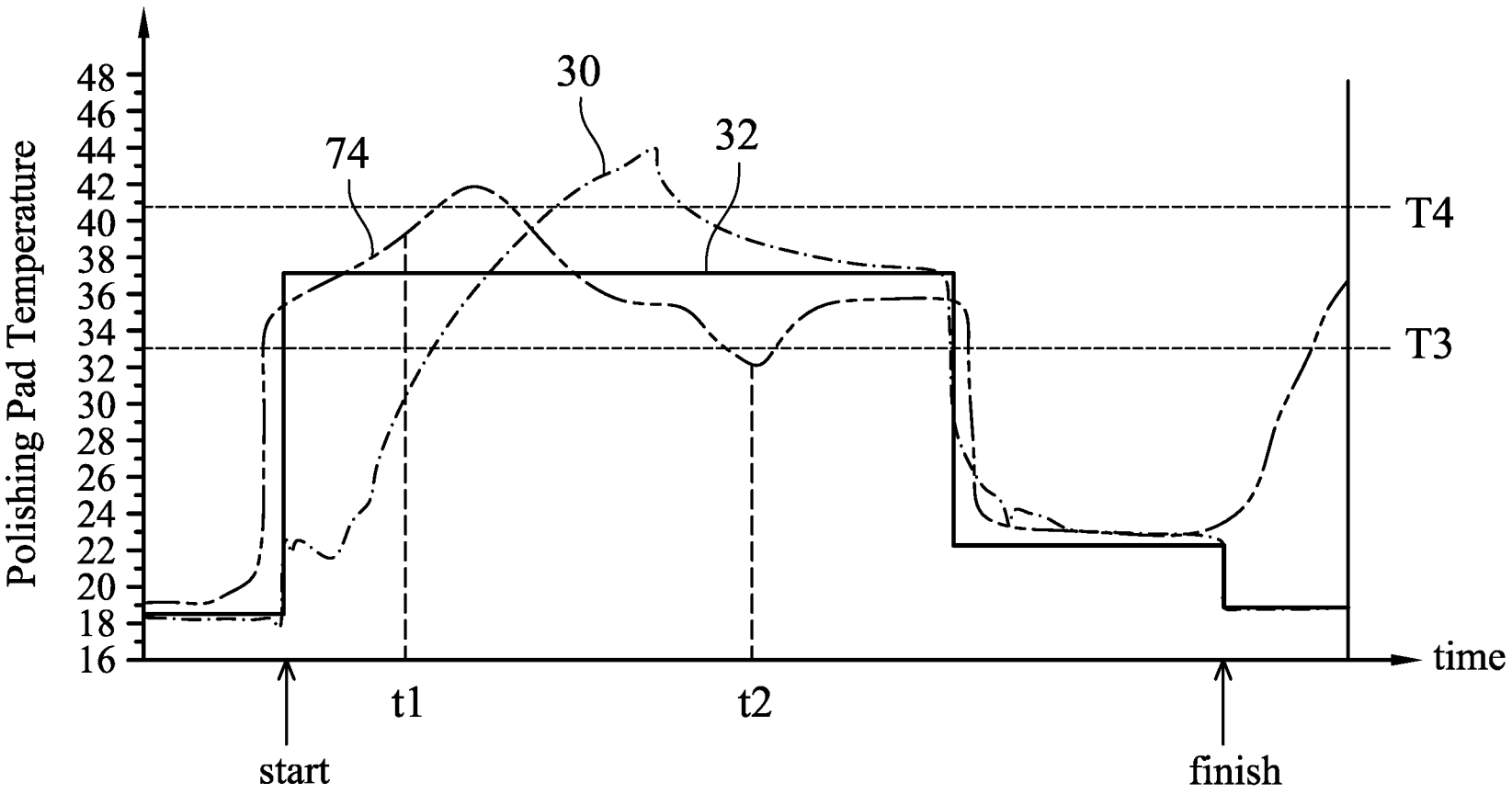

FIG. 7 illustrates another exemplary temperature profile of a polishing pad for the polishing of another wafer. Line 74 represents the temperature of polishing pad 14. Before the "start" time, at which time point the wafer starts to be polished, a heating media is conducted into pad conditioner 26 (FIG. 1), so that the temperature is raised into the desirable range T3~T4 (FIG. 2). The wafer then starts to be polished. During the CMP, the temperature of polishing pad 14 (FIG. 1) is monitored, for example, using thermometer 62 (FIG. 1). Assuming at time t1, the polishing pad 14 is detected as having a temperature higher than the upper limit T4 of the desirable range, controller 66 (FIG. 1) will control coolant dispensing units 68 and/or 70 to dispense a coolant into pad conditioner 26 and/or wafer holder 16. Polishing pad 14 is thus cooled down until the temperature of the polishing pad is brought back into the desirable range T3~T4. Assuming at time t2 (FIG. 7), the polishing pad 14 is detected as having a temperature lower than the lower limit T3 (FIG. 2) of the desirable range, controller 66 (FIG. 1) will control a heating media to be conducted into pad conditioner 26 and/or wafer holder 16 to heat polishing pad 14 until the temperature of polishing pad 14 is brought back into the desirable range. When the detected temperature is in the desirable range T3~T4, disk 20 may be moved away from polishing pad 14, or a heat-exchange media with a temperature close to the temperature of polishing pad 14 may be conducted. Alternatively, when the detected temperature is in the desirable range T3~T4, no coolant or heating media is conducted into disk 20 and wafer holder 16.

The embodiments of the present disclosure have some advantageous features. The platen underlying the polishing pad may be conducted with a coolant to lower the temperature of polishing pad. The polishing pads, however, are formed of porous materials, and are thermal insulators. It is very difficult to transfer heat at the top surface of a polishing pad to the platen through the polishing pad. It is found that when the platen is cooled down by 20 degrees centigrade, the top surface temperature of the polishing pad can only be lowered by about 2 degrees centigrade. In accordance with some embodiments of the present disclosure, the heat exchange is achieved directly with the top surface of polishing pad 14, and the heat does not have to go through the thermal-insulating polishing pad 14. The thermal-transfer efficiency is much higher. In addition, the cooling/heating mechanism is built in the existing components (pad conditioner and wafer holder), and hence no additional component is added to interfere with the operation of the existing components. The embodiments of the present disclosure also provide a mechanism for heating the polishing pad in order to improve the throughput of the CMP process.

In accordance with some embodiments of the present disclosure, a method includes polishing a wafer on a polishing pad, performing conditioning on the polishing pad using a disk of a pad conditioner, and conducting a heat-exchange media into the disk. The heat-exchange media conducted into the disk has a temperature different from a temperature of the polishing pad.

In accordance with some embodiments of the present disclosure, a method includes polishing a wafer on a polishing pad, performing conditioning on the polishing pad using a disk of a pad conditioner, and conducting a coolant into and out of the disk. The coolant is configured to lower a top surface temperature of the polishing pad. The method further includes conducting a heating media into and out of the disk. The heating media is configured to raise the top surface temperature of the polishing pad.

In accordance with some embodiments of the present disclosure, a method includes polishing a wafer on a polishing pad, and performing a first detection to detect a temperature of the polishing pad. In response to the detected temperature to be higher than a first pre-determined temperature, a coolant is conducted into and out of a disk of a pad conditioner. The disk performs conditioning on the polishing pad when the coolant is conducted. In response to the detected temperature to be lower than a second pre-determined temperature, a heating media is conducted into and out of the disk. The pad conditioner performs conditioning on the polishing pad when the heating media is conducted.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An apparatus comprising:

a polishing pad;

a pad conditioner adjacent to the polishing pad, wherein the pad conditioner comprises a first channel and a second channel therein;

a heat-exchange supplying unit connected to the first channel and the second channel; and a control unit configured to control operations of the pad conditioner and the heat-exchange supplying unit, wherein the control unit is configured to:

conducting a first heat-exchange media through one of the first channel and the second channel with a first flow rate, wherein the first heat-exchange media is at a first temperature; and conducting a second heat-exchange media through one of the first channel and the second channel with a second flow rate different from the first flow rate, wherein the second heat-exchange media is at a second temperature different from the first temperature, and wherein either both of the first temperature and the second temperature are higher than a temperature of the polishing pad, or both of the first temperature and the second temperature are lower than the temperature of the polishing pad.

2. The apparatus of claim 1, wherein both of the first heat-exchange media and the second heat-exchange media are heating medias.

3. The apparatus of claim 1, wherein both of the first heat-exchange media and the second heat-exchange media are coolants.

4. The apparatus of claim 1, wherein the control unit is configured to control whether to conduct the first heat-exchange media or the second heat-exchange media in response to the temperature of the polishing pad.

5. The apparatus of claim 1 further comprising:

a wafer holder configured to hold a wafer, with the wafer contacting the polishing pad, wherein the wafer holder comprises an additional channel therein, with the additional channel configured to have an additional heat-exchange media flowing through, and wherein the control unit is configured to control a flow of the additional heat-exchange media in the additional channel.

6. The apparatus of claim 1, wherein the control unit is configured to control the first heat-exchange media to flow into the first channel and the second heat-exchange media to flow into the second channel.

7. The apparatus of claim 1 further comprising a thermometer connected to the control unit, wherein the thermometer is configured to measure the surface temperatures of the polishing pad.

8. The apparatus of claim 7, wherein the control unit is configured to, in response to a measured surface temperature of the surface temperatures of the polishing pad:

conduct the first heat-exchange media to have the first flow rate; or conduct the second heat-exchange media to have the second flow rate different from the first flow rate.

9. An apparatus comprising:

a polishing platen;

a polishing pad over the polishing platen;

a pad conditioner configured to condition the polishing pad, wherein the pad conditioner comprises at least one channel therein; and a heat-exchange supplying unit connected to the at least one channel;

a control unit configured to control operations of the pad conditioner and the heat-exchange supplying unit, wherein the control unit is configured to:

in response to a first surface temperature of the polishing pad, conduct a first heat-exchange media having a first temperature into the at least one channel; and in response to a second surface temperature of the polishing pad different from the first temperature, conduct a second heat-exchange media having a second temperature different from the first temperature into the at least one channel, wherein either both of the first temperature and the second temperature are higher than the first surface temperature and the second surface temperature, or both of the first temperature and the second temperature are lower than the first surface temperature and the second surface temperature.

10. The apparatus of claim 9, wherein both of the first temperature and the second temperature are higher than the first surface temperature and the second surface temperature, and the first heat-exchange media and the second heat-exchange media are heating medias.

11. The apparatus of claim 9, wherein both of the first temperature and the second temperature are lower than the first surface temperature and the second surface temperature, and the first heat-exchange media and the second heat-exchange media are coolants.

12. The apparatus of claim 9, wherein the at least one channel comprises:

a first channel; and a second channel separated from the first channel.

13. The apparatus of claim 9, wherein the control unit is configured to control the first heat-exchange media to flow at a first flow rate, and the second heat-exchange media to flow at a second flow rate different from the first flow rate.

14. An apparatus comprising:

a polishing platen;

a polishing pad over the polishing platen;

a wafer holder configured to rotate a wafer against the polishing pad, wherein the wafer holder comprises at least one first channel therein;

a pad conditioner configured to condition the polishing pad, wherein the pad conditioner comprises at least one second channel therein;

a heat-exchange supplying unit configured to store a first heat-exchange media and a second heat-exchange media therein, wherein the heat-exchange supplying unit is connected to one of the at least one first channel and the at least one second channel, wherein the first heat-exchange media is at a first temperature, and the second heat-exchange media is at a second temperature different from the first temperature, and wherein both of the first temperature and the second temperature are higher than or lower than a surface temperature of the polishing pad; and a control unit configured to select one of the first heat-exchange media and the second heat-exchange media to flow into the at least one first channel or the at least one second channel in response to the surface temperature of the polishing pad.

15. The apparatus of claim 14, wherein the control unit is configured to control the first heat-exchange media to flow at a first flow rate, and the second heat-exchange media to flow at a second flow rate different from the first flow rate.

16. The apparatus of claim 14, wherein the at least one first channel comprises two channels.

17. The apparatus of claim 1 further comprising a thermostat configured to detect the temperature of the polishing pad.

18. The apparatus of claim 9 further comprising a thermostat configured to detect the first surface temperature and the second surface temperature of the polishing pad.

19. The apparatus of claim 14 further comprising a thermostat configured to detect the surface temperature of the polishing pad.

20. The apparatus of claim 19 further comprising, wherein the thermostat is configured to detect the surface temperature of the polishing pad through non-contact detection.

* * * * *